US005105350A

United States Patent [19]

Tolman et al.

[11] Patent Number: 5,105,350

[45] Date of Patent: Apr. 14, 1992

[54] BRACKET ARMS FOR TRAFFIC LIGHT ASSEMBLIES

[76] Inventors: DeLoy E. Tolman, 3425 Hawthorn; Ronald D. Tolman, 3123 Oakview, both of Chino Hills, Calif. 91709

[21] Appl. No.: 715,677

[22] Filed: Jun. 14, 1991

[51] Int. Cl.[5] ..... F21S 1/10

[52] U.S. Cl. ..... 362/431; 362/250; 362/370; 248/219.1

[58] Field of Search ..... 362/370, 431, 430, 249, 362/250; 248/219.1, 231.9, 295.1; 340/907, 925

[56] References Cited

U.S. PATENT DOCUMENTS 4,489,910 12/1984 Ferguson ..... 248/231.9 X
4,914,435 4/1990 Gould et al. ..... 340/925 X

FOREIGN PATENT DOCUMENTS 109642 2/1940 Australia ..... 340/907
1441542 1/1969 Fed. Rep. of Germany ..... 340/907

*Primary Examiner*—Stephen F. Husar
*Attorney, Agent, or Firm*—Boniard I. Brown

[57] ABSTRACT

A bracket arm mechanism for mounting multiple traffic light assemblies on a common vertical post structure. At least one of the bracket arms has a collar at one end for telescopement onto the post structure so that the arm is adjustable vertically to accommodate a traffic light assembly of reduced vertical height. An angular transition portion between each collar and the main portion of the associated bracket arm provides for the bracket arms being in a common plane suitable for mounting a plural number of standard height traffic light assemblies on the post structure.

10 Claims, 2 Drawing Sheets

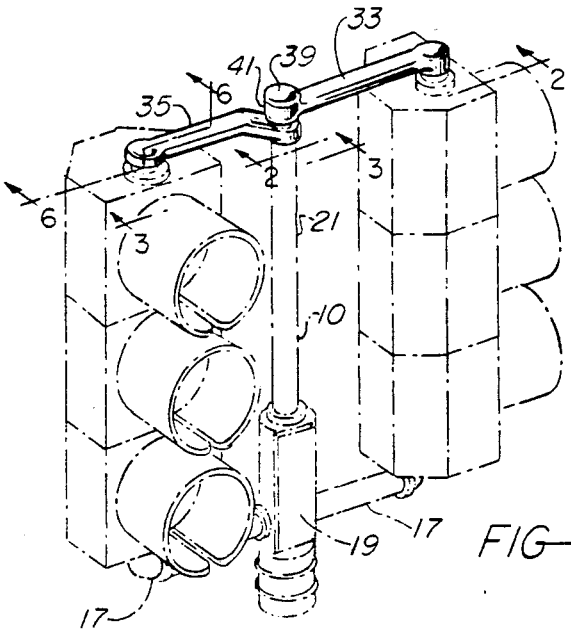
FIG—.1
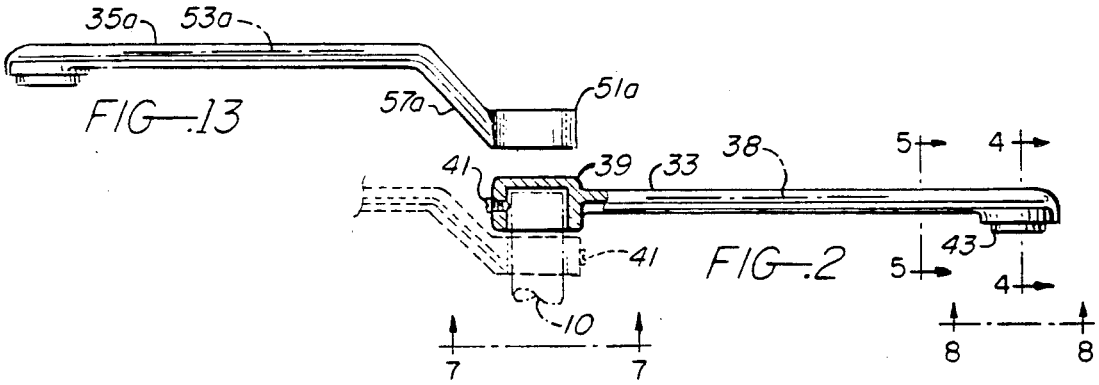
FIG—.13
FIG—.2
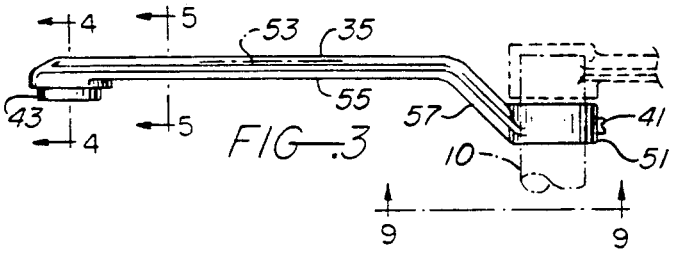
FIG—.3
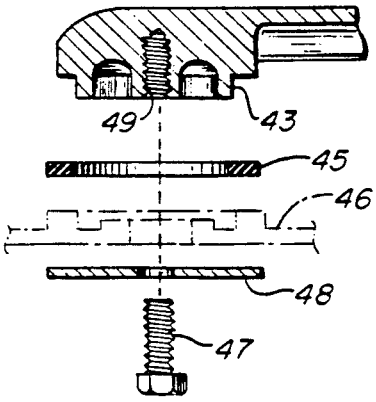
FIG—.6
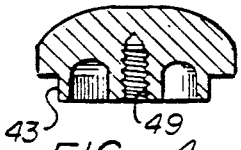
FIG—.4
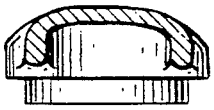
FIG—.5

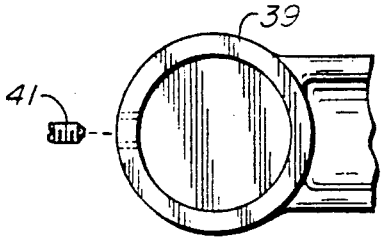
FIG—.7
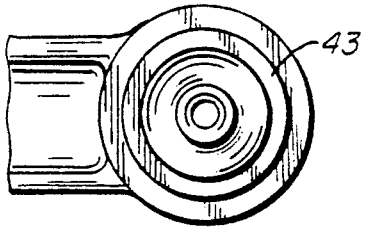
FIG—.8
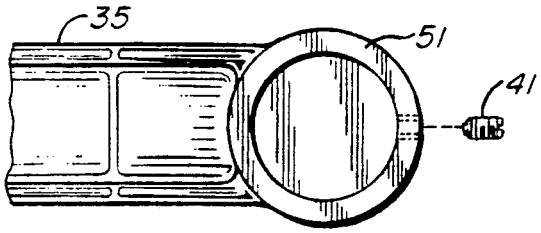
FIG—.9
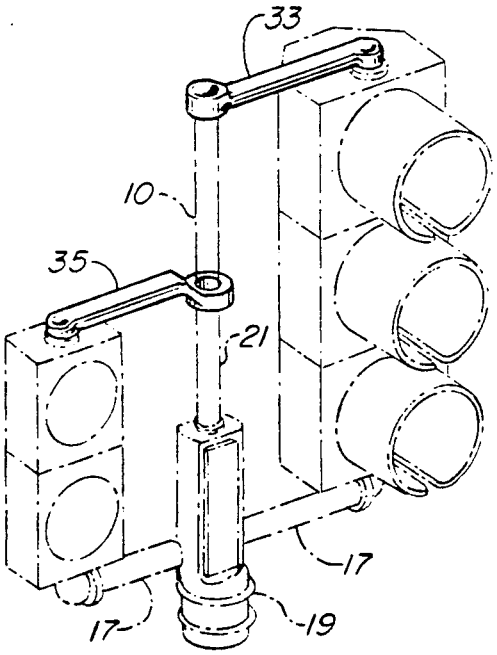
FIG—.10
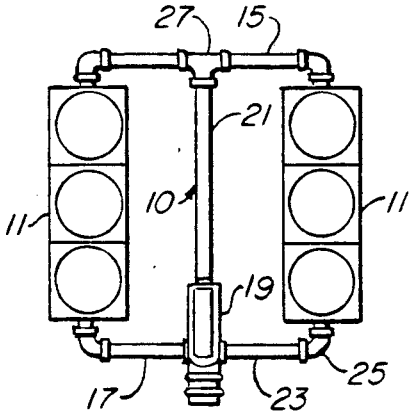
FIG—.11
(PRIOR ART)
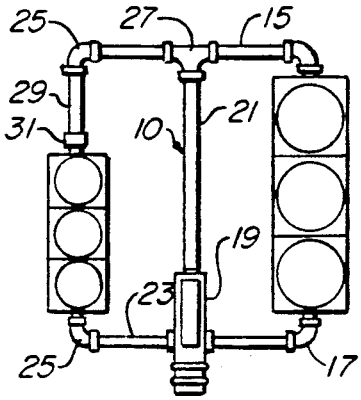
FIG—.12
(PRIOR ART)

BRACKET ARMS FOR TRAFFIC LIGHT ASSEMBLIES

BACKGROUND AND SUMMARY OF THE INVENTION

The present invention relates generally to traffic lights, and more particularly to a novel bracket mechanism for partially supporting one or more traffic light units in spaced relation to vertical post means.

It is known to arrange traffic light assemblies in multiple groupings about central vertical post means. Typically, each traffic light assembly comprises a red stop light, a green "go" light, and a yellow caution light. The three lights of each assembly are arranged in vertical array. Each multiple group of lights is commonly located at a traffic intersection so that one set of lights faces each oncoming stream of vehicular traffic. In the case of a four-way traffic intersection, each traffic signal system will include four sets of traffic signals facing the four directions of oncoming traffic. Three-way traffic intersections and two-way intersections will have three sets of signals and two sets of signals, respectively. In each case, the individual traffic signal assemblies are equidistant from vertical post means, which may be suspended from an overhead cable or may extend upwardly from a vertical mast structure.

Under conventional practice, each traffic signal assembly is connected to the supporting post means via upper and lower cantilever arms. Typically, each cantilever arm includes a horizontal pipe threaded at its opposite ends, an internally threaded elbow connected to one end of the pipe, and a screw extending through a wall of the traffic signal assembly into the elbow. One end of each horizontal pipe is threadedly connected to the central post means, whereby each signal assembly is spaced from the post.

The post means commonly comprises a vertically elongated terminal box and a vertical pipe extending upwardly from the box. The upper horizontal pipes are connected to the upper end of the vertical pipe via a threaded connector, which may have therein one, two, three or four threaded openings, depending on the number of traffic light units in the system. The lower horizontal pipes are threaded into threaded openings in the terminal box. Electrical wiring for the traffic lights extends from the terminal box through the lower horizontal pipes and associated elbows up into the traffic light housings.

In some cases, the vehicular traffic signals are combined with pedestrian signals and/or vehicular turn signals. The light housing dimensions for such pedestrian signals and turn signals are smaller than corresponding dimensions for the stop-and-go vehicular signals. Therefore, when a particular installation has pedestrian signals or turn signals incorporated therein, it is necessary to use an additional vertical pipe connector between each smaller signal assembly and the associated upper horizontal support pipe. This somewhat complicates the installation process, and increases parts inventory requirements.

The present invention relates to a bracket mechanism which can be substituted for the upper horizontal pipes in the above-mentioned traffic light support system. A particular aim of the invention is to provide a bracket mechanism wherein one of the bracket arms is slidably adjustable on the central post means, whereby the bracket arm can be used either with the full height vehicular signals or with the shorter pedestrian signals or vehicle turn signals. Use of the slidably adjustable bracket arm eliminates the need for the above-mentioned additional vertical pipe connector. In one form, the invention comprises at least two horizontal bracket arms having the same lenth. One of the bracket arms has a downwardly extending socket or cap at one end for telescopement over the upper end of the supporting post means. The other bracket arm has a collar at one end for slidable encirclement of the post means below the socket (cap) on the first bracket arm. The collar on this second bracket arm is downwardly offset from the longitudinal axis of the second arm, whereby both arms can be disposed in a common horizontal plane passing through the upper end of the central post means. With the described bracket arm arrangement, it is possible to support a multiplicity of standard height vehicular stop-and-go light assemblies or various combinations of standard height assemblies and reduced height light assemblies.

BRIEF DESCRIPTION OF THE DRAWINGS

FIG. 1 is a perspective view of a bracket mechanism embodying the invention, showing conventional vehicular light system hardware in dashed lines;

FIG. 2 is a view taken on line 2—2 in FIG. 1;

FIG. 3 is a view taken on line 3—3 in FIG. 1;

FIG. 4 is a sectional view taken on line 4—4 in FIGS. 2 and 3;

FIG. 5 is a sectional view taken on line 5—5 in FIGS. 2 and 3;

FIG. 6 is an exploded fragmentary view taken on line 6—6 in FIG. 1;

FIG. 7 is a fragmentary view taken on line 7—7 in FIG. 2;

FIG. 8 is a fragmentary view taken on line 8—8 in FIG. 2;

FIG. 9 is a fragmentary view on line 9—9 in FIG. 3;

FIG. 10 is a perspective view similar to that of FIG. 1, but showing the mechanism adjusted to support a different combination of traffic lights;

FIGS. 11 and 12 are elevational views of a prior art support mechanism for traffic lights; and FIG. 13 is a view similar to that of FIG. 3, but illustrating another bracket arm structure embodying the invention.

DESCRIPTION OF A PREFERRED EMBODIMENT OF THE INVENTION

Referring to the drawings, FIG. 11 shows a prior art traffic signal system including a vertical post means 10 and two separate traffic light assemblies 11 oriented parallel to post means 10. Each traffic light assembly comprises three separate light units, typically a red light, a green light, and a yellow caution light.

Each traffic light assembly is connected to the post means 10 via an upper cantilever arm structure 15 and a lower cantilever arm structure 17. The post means comprises a hollow rectangular junction box 19 and a vertical pipe 21. Each lower arm structure 17 comprises a horizontal pipe 23 threaded into a side wall of box 19 and an elbow 25 threaded onto the free end of pipe 23. A tubular screw type fastener extends through the end wall of the associated light housing into elbow 25 to rigidly attach the light housing to the cantilever are structure. Each pipe 23 serves as an electrical conduit for wiring extending from box 19 to the light housings.

Each upper arm structure 15 is a duplicate of the lower arm structures 17. A threaded T-shaped pipe connector 27 is threaded onto the upper end of vertical pipe 21 to form a connection between the post means 10 and the cantilever arm structure.

FIG. 11 shows a traffic signal system having two separate traffic light assemblies supported by post means 10. Two additional traffic light assemblies may be connected to the post means by using additional cantilever arm structures similar to arm structures 15 and 17. Each traffic light assembly will usually face away from post means 10 for viewing by oncoming drivers at a traffic intersection.

FIG. 12 shows a modification of the FIG. 11 prior art arrangement, wherein one of the light assemblies has a shorter vertical dimension than the other standard vehicular traffic light assembly. The shorter light assembly may typically be a pedestrian signal light assembly or a vehicle turn signal assembly. In order to mount the shorter light assembly, an additional vertical pipe 29 and threaded collar 31 are interposed between the associated elbow 25 and the tubular screw type fastener which extends upwardly through the top wall of the light housing.

FIGS. 1 and 10 show bracket arm mechanisms according to the present invention as alternatives to the upper cantilever arm structures 15 and add-on pipe-collar assemblies or FIGS. 11 and 12. In practicing the present invention, the original lower cantilever arm structures 17 depicted in FIGS. 11 and 12 may be used.

FIG. 1 shows a first horizontal bracket arm 33 extending between post means 10 and one of the traffic light assemblies, and a second horizontal bracket arm 35 extending between post means 10 and the other traffic light assembly. Each bracket arm is a unitary one-piece member formed as an aluminum alloy or ductile iron casting.

Bracket arm 33 has a longitudinal axis 38 extending generally horizontally radially outwardly from post means 10 when the bracket arm is installed. An integral hollow cap or socket 39 is formed on one end of arm 33 for telescopement over the upper end of the post means. Retention of the arm on the post means is provided by a set screw 41 extending through the wall of socket 39. The free outer end of arm 33 includes a downwardly extending plug portion 43 having an outer diameter mated to a circular hole in the top wall 46 of the associated light housing; an elastomeric gasket 45 fits onto the plug portion to prevent entry of rain water into the light housing. Connection of the bracket arm to the light housing is effected by a fastener screw 47 extendable through washer 48 into a threaded opening 49 in plug portion 43.

The second bracket arm 35 is also preferably a unitary one-piece metal casting. At its inner end, the bracket arm has an integral annular collar 51 adapted to slidably telescope onto post means 10 to occupy a position below hollow cap 39. A second set screw 41 extends through the collar wall to lock arm 35 to the post means.

Arm 35 has a longitudinal axis 53 extending in a horizontal plane when collar 51 is telescoped onto the post means. The arm includes a main straight portion 55 defining longitudinal axis 53, and a transition portion 57 extending augularly downwardly between main portion 55 and collar 51. When collar 51 is in close adjacency to cap 39, as shown in FIGS. 1 through 3, the longitudinal axis 53 of arm 35 is coplanar with longitudinal axis 38 of arm 35. This causes the effective vertical spacing between each arm 35 and the subjacent lower arm 17 to be the same as the vertical spacing between each arm 33 and the subjacent lower arm 17. As a result, a standard height light assembly can be mounted between each set of arms 35, 17 or 33, 17. Each arm 35 has a downwardly extending plug portion 43 at its outer end for connection of the arm to the associated light housing.

FIG. 1 shows a bracket mechanism for supporting two traffic light assemblies outboard from post means 10. Two additional traffic light assemblies may be mounted on the post means by using additional bracket arms constructed generally like bracket arm 35. However, each additional bracket arm has a different length transition portion. As shown in FIG. 2, an additional bracket arm **35*a* has a transition portion 57*a* slightly longer than the transition portion 57 shown in FIG. 3. With the longer length transition portion, the bracket arm 35*a* can be positioned with its collar 51*a* located below collar 51 (in FIG. 3) and with its longitudinal axis 53*a* coplanar with the corresponding axes of arms 33 and 35. By varying the length of the angulated transition portion 57, 57*a*, etc., it is possible to accommodate three or four standard height traffic light assemblies about post means 10**.

FIG. 10 shows a bracket arm 35 adjusted downwardly on post means 10 for mounting a shortened traffic light assembly, the bracket arm being used without any additional spacer device of the type shown at 29, 31 in FIG. 12.

A principal feature of the present invention is the ability of the bracket arm mechanisms to accommodate traffic light assemblies having different vertical dimensions. Another feature of the invention is that each bracket arm has at least some slidable adjustability on post means 10, whereby the gaskets 45 can fit tight aganst the walls of the associated traffic light housings. In this connection, socket 39 and collar 51 can be slidably adjusted on the post means to cause the associated bracket arms to assume desired positions relative to the associated light housings. Such adjustments are not possible with the prior art bracket arms. A further feature of the invention is the unitary nature of each bracket arm 33 or 35, which require no assembly of component hardware.

Thus there has been shown and described novel bracket arms for traffic light assemblies which fulfill all the objects and advantages sought therefor. Many changes, modifications, variations and other uses and applications of the subject invention will, however, become apparent to those skilled in the art after considering this specification together with the accompanying drawings and claims. All such changes, modifications, variations and other uses and applications which do not depart from the spirit and scope of the invention are deemed to be covered by the invention which is limited only by the claims which follow.

The inventors claim:

1. In a traffic signal system having vertical post means, a first traffic light assembly parallel to said post means, first cantilever support means extending between the post means and the first traffic light assembly for transferring the weight of the traffic light assembly to the post means, a second traffic light assembly parallel to said post means, and second cantilever support means extending between said post means and said second traffic light assembly for transferring the weight of said second assembly to the post means, the improvement comprising:

a first horizontal arm being the first support means and having a hollow cap at one end thereof adapted to telescope over the upper end of the post means, and a second horizontal arm being the second support means and having an annular collar at one end thereof adapted to telescope onto the post means to occupy a position below said hollow cap.

2. The improvement according to claim 1, wherein:

said first arm has a longitudinal axis extending generally horizontally when the hollow cap is telescoped onto the upper end of the post means, and.

said second arm has a longitudinal axis extending generally horizontally when said collar is telescoped onto the post means, said second arm being adjustable on the post means to a position wherein the longitudinal axis of the second arm is generally coplanar with the longitudinal axis of the first arm.

3. The improvement according to claim 2, wherein:

said second arm comprises a straight linear arm portion defining the longitudinal axis of the second arm portion, and a transition portion extending angularly between said collar and said straight linear arm portion.

4. The improvement according to claim 2, wherein:

each arm has a downwardly extending plug portion adapted to fit into a circular opening in an associated traffic light assembly.

5. The improvement according to claim 4, wherein:

each plug portion has therein a threaded socket opening adapted to receive a fastener screw.

6. The improvement according to claim 5, wherein:

said plug portion and said collar are integral parts of said second arm.

7. The improvement according to claim 1, and further comprising:

set screw means extending through said collar for securing said second arm to said post means.

8. A bracket mechanism for attaching multiple traffic light units to upstanding posts means, said bracket mechanism comprising:

a first horizontal bracket arm having a downwardly extending socket adapted to fit onto the upper end of the post means, and a second horizontal bracket arm having a collar adapted to encircle the post means below said socket, said second bracket arm being slidably adjustable on the post means for movement between a raised position wherein said second arm is in planar alignment with said first arm and a lowered position wherein said second arm is generally horizontal and is spaced below the plane of said first arm.

9. A bracket mechanism for attaching multiple traffic light units to upstanding posts means, said bracket mechanism comprising:

a first horizontal bracket arm having a downwardly extending socket adapted to fit onto the upper end of the post means, and a second horizontal bracket arm having a collar adapted to encircle the post means below said socket, the first and second arms having the same length.

10. A bracket mechanism for attaching multiple traffic light units to upstanding posts means, said bracket mechanism comprising:

a first horizontal bracket arm having a downwardly extending socket adapted to fit onto the upper end of the post means, a second horizontal bracket arm having a collar adapted to encircle the post means below said socket, said second bracket arm having a free end spaced from the post means, and said second arm having a downwardly projecting plug portion adapted to fit into a fastener opening in an associated traffic light unit.

* * * * *